US012035828B2

(12) United States Patent
Zhigunovsky et al.

(10) Patent No.: US 12,035,828 B2
(45) Date of Patent: Jul. 16, 2024

(54) SHOE HORN

(71) Applicant: Once and Forever, LLC, Naberezhnye Chelny (RU)

(72) Inventors: Sergey M. Zhigunovsky, Naberezhnye Chelny (RU); Nikolay A. Panchekhin, Naberezhnye Chelny (RU)

( * ) Notice: Subject to any disclaimer, the term of this patent is extended or adjusted under 35 U.S.C. 154(b) by 121 days.

(21) Appl. No.: 17/693,857

(22) Filed: Mar. 14, 2022

(65) Prior Publication Data

US 2022/0287493 A1 Sep. 15, 2022

(30) Foreign Application Priority Data

Mar. 13, 2021 (RU) ..... RU2021106534

(51) Int. Cl.
*A47G 25/82* (2006.01)

(52) U.S. Cl.
CPC ..... *A47G 25/82* (2013.01)

(58) Field of Classification Search
CPC ..... A47G 25/82; A63B 69/02; A63C 11/222; A45B 9/02; A45B 2009/025; F41B 13/02
See application file for complete search history.

(56) References Cited

U.S. PATENT DOCUMENTS 1,886,567 A * 11/1932 Marble ..... F41B 13/02 30/295
2,544,563 A * 3/1951 Moehle ..... F41B 13/02 403/258
3,501,073 A * 3/1970 Joachim-Hans ..... A47G 25/902 223/118
2011/0226821 A1* 9/2011 McGuire ..... A47G 25/82 223/118
2012/0211532 A1* 8/2012 Santos ..... A47G 25/82 223/118

* cited by examiner

*Primary Examiner* — F Griffin Hall
(74) *Attorney, Agent, or Firm* — Lawrence G. Fridman, ESQ; FEIGIN & FRIDMAN, LLC

(57) ABSTRACT

The invention relates to the field of satisfying human needs and specifically relates to the structure of a device for putting on footwear. The shoe horn consists of a blade in the form of a trapezoid rod with a longitudinal groove along its entire length. The guard is mounted on the blade using the press fitting method. A grip is shaped as a steel tube and press fitted on the narrowed part of the blade and touching the guard. A wedge with a pommel is press fitted into the tube of the grip. The design of the invention ensures perfect balance of the shoe horn.

13 Claims, 3 Drawing Sheets

SHOE HORN

CROSS-REFERENCE TO RELATED APPLICATIONS

This application claims priority of Russian Patent Application RU 2021106534 filed Mar. 13, 2021 the disclosure of which is hereby incorporated by reference in its entirety.

FIELD OF THE INVENTION

The invention relates to the field of satisfying human needs and specifically relates to a shoe horn or a structure of a device for putting on footwear.

BACKGROUND OF THE INVENTION

There is a known a model of a shoe horn that consists of a handle in its upper part and a blade in its lower part. Shoe horns of very different shapes and sizes, long or short, made of steel and plastic, consisting of a grip and a blade, are known.

The technical solution known to the applicants and that resembles the claimed one is an elongated shoe horn (CA2167950 dd. 1997 Jul. 25) consisting of an elongated piece that has a narrower upper part and a wider lower part, and has a hook-type configuration in its narrower upper part. The shortcoming of this technical solution is its narrow scope of application, uncomfortable use, namely the difficulty of holding it in hands of a user.

SUMMARY OF THE INVENTION

It is the task of the invention to engineer a dual-purpose shoe horn—a shoe horn and a weapon usable in close combat—the solution to which the claimed invention attempts to carry out.

This task is accomplished by the fact that the shoe horn for putting on footwear consists of a blade in the form of a trapezoid rod with a longitudinal groove along its entire length, a guard mounted on the blade using the press fitting method, a grip shaped as a steel tube and press fitted on the narrowed part of the blade and touching the guard, a wedge with a pommel press fitted into the tube of the grip.

The technical result ensured by the listed sum total of the features manifests itself in making the shoe horn balanced in the area of the guard.

BRIEF DESCRIPTION OF THE DRAWINGS

The essence of the invention is illustrated by the drawings wherein.

DESCRIPTION OF THE INVENTION

Figure 1:
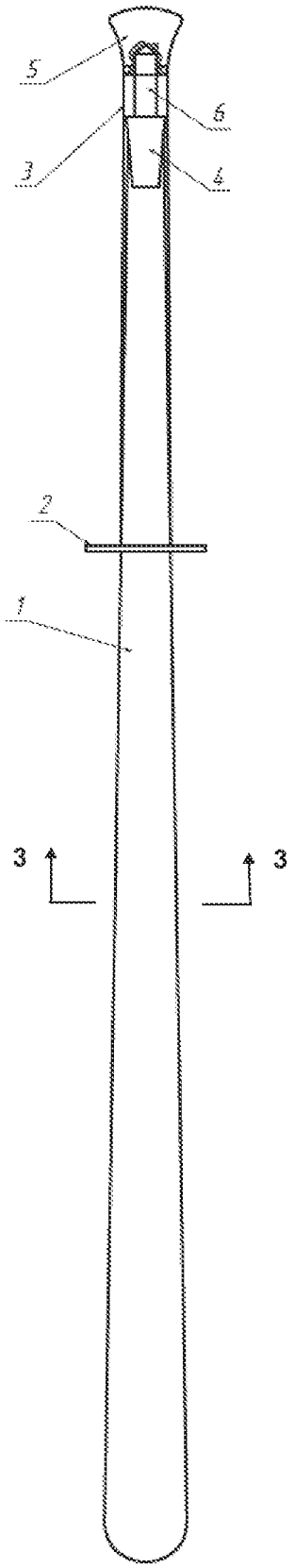
FIG. 1—a front view of the device.
Figure 2:
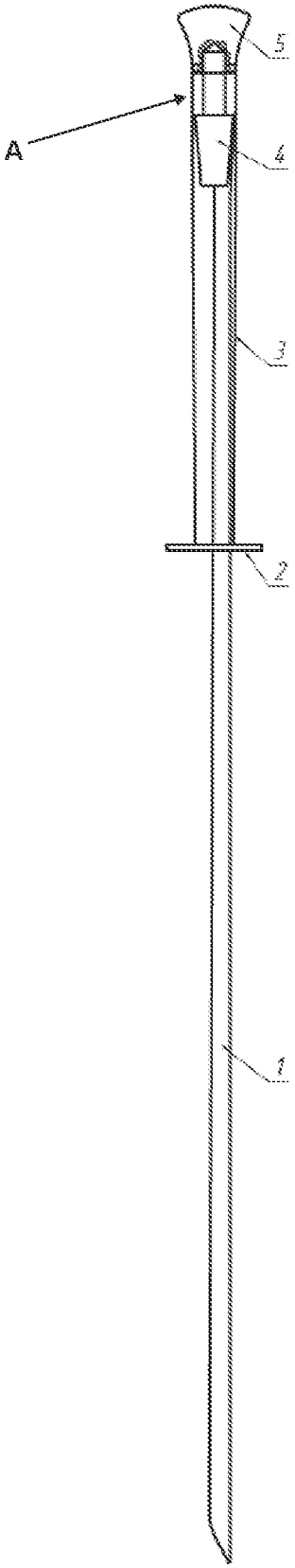
FIG. 2—a side view of the device.
Figure 3:
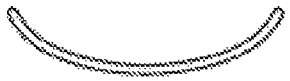
FIG. 3—a cross-section of the blade according to section line 3-3 of FIG. 1, FIG. 4—an enlarged view of detail A of FIG. 2, and FIG. 5—a view of the guard.

The shoe horn for putting on footwear consists of the following essential units: the blade 1, the guard 2, the grip tube 3, the wedge 4 and the pommel 5. The blade 1 is a trapezoid-shaped rod with a longitudinal groove along its entire length.

The guard 2 has a rounded shape and formed with circular holes of varying diameter along the edge of the circumference. Such position of the holes ensures the most authentic outlook and resembles the Japanese style of weapon design.

The grip tube 3 is a rounded steel tube.

The wedge 4 is a truncated cone with extension bar 6 with a threaded connection at the end. The extension bar 6 is designed to be cylindrical in shape, By selecting the thickness of the extension bar (diameter) the needed balancing adjustment of the whole device is achieved.

The pommel 5 has a complex geometrical semi-spherical shape with a threaded inner part.

Figure 4:
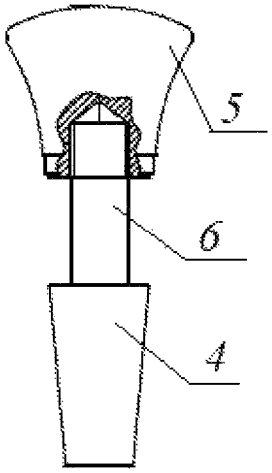
Figure 5:
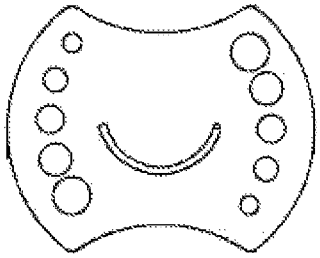

The central unit that holds the whole shoe horn together is the blade 1. The guard 2 is mounted on the narrower side of the blade 1 by means of the press fitting method. The grip tube 3 that touches the guard 2 is also press fitted on the narrower part of the blade. The wedge 4 is screwed into the pommel 5 by means of a threaded connection on the extension bar 6. At the next stage, the wedge 4 with the extension bar and the pommel 5—as a whole unit—is press fitted into the grip tube. FIG. 4 shows the wedge 4 with a pommel 5 before it is press fit into the grip tube 3.

In the process of press fitting the wedge 4, the maximum diameter of the wedge cone is coupled with the narrower end of the blade 1 and, due to the addition of the thicknesses of the parts, the grip/handle tube 3 expands to ensure maximum traction of all the components of the shoe horn.

The blade of the shoe horn has an elongated design which makes the shoe horn of the invention user-friendly, especially for elderly people or people who bend with difficulty. The fact that the shoe horn has a balanced design also allows it to be held in the hand in a steady fashion and with ease.

The shoe horn has a perfectly balanced design which allows it to be used as sports equipment in fencing sports.

The grip of the shoe horn may be wrapped in various decorative materials such as straps, velvet, or leather.

The pommel may be complimented with engravings, or medallions made of various materials and metals. The blade can also be complimented with engravings produced by various methods of engraving.

The blade is made of stainless steel. The guard is made of stainless steel. The grip tube is made of chrome-plated steel. The wedge is made of type 35 steel. The pommel is made of D16T alloy.

The shoe hone has the balancing point in the area of the guard which allows one to use the shoe horn as sports equipment in fencing practice as well. The balance distribution of the shoe horn is achieved by means of the geometry of the wedge and the pommel which ensure correct distribution of the weight characteristics of said parts inside the grip tube. The steel wedge has a geometry which combines the length and the thickness to obtain a specific weight which, together with the weight of the duralumin pommel, ensures the balancing point of the complete piece to be located in the area of the guard. The shoe horn has therefore two lever arms, one arm being the grip with the pommel, the other arm being the blade, and the two arms are balanced in the area of the guard.

Preferable dimensions of the parts of the device:

- the blade length is 830 mm, the thickness is 1.5 mm. The width of the widest side of the blade is 53 ruin, and 24 mm for the narrowest side. The radius of the widest side of the blade is 25 mm, the radius of the narrowest side of the blade is 15 mm,
- the guard has the outer diameter of 68 mm and the central inner slot 1.6 mm wide, the radius of the slot is 8 mm, the grip tube has a wall thickness of 0.8 mm, the length is 260 to 290 mm, and the diameter is 25 mm, the wedge has the total length of 80 mm, the cone length is 40 mm, the diameter of the smallest side of the cone is 15 mm, the diameter of the largest side of the cone is 22.5 mm, the length of the extension bar is 40 mm, an M14 threaded connection with the thread length of 13 mm, the extension bar diameter is 13 mm, the pommel is made of the D16T alloy and has the following dimensions: length: 39 mm, maximum diameter: 41 min, minimal diameter: 25 mm. The diameter of the seat for press fitting into the grip tube is 24 mm. The height of the seat is 4 mm. The inner hole has an M14 thread and is 15 mm deep, the weight of the complete item is 770 g, the total length is 88 mm, the grip length is 30 mm.

The claimed technical solution of the invention has therefore the following competitive advantages:

usability due to the shoe horn's elongated design the makes it possible to use it without bending;

versatility due to the options of being used as a shoe horn and as a weapon;

aesthetically pleasing appearance;

perfect balance ensured by a special design of the wedge and the pommel which allows the device to be used as a close combat weapon for practice,

The invention claimed is:

1. A shoe horn, comprising: a blade having a wide side and a narrow side with a length of 830 mm, a thickness of 1.5 mm, the blade is in the form of a rod having an arc shape cross section and a rounded distal end, a longitudinal groove extends along an entire length of the rod, a width of the wide side of the blade is 53 mm, a width of the narrow side of the blade is 24 mm, a radius of the wide side is 25 mm, a radius of the narrow side is 15 mm; a guard with an outer diameter of 68 mm and a central inner slot provided for slidable receiving of the blade, a grip mounted on the blade, the grip shaped as a tube, a grip inner unit comprising interconnected a wedge cone, an extension bar and a pommel positioned in the tube of the grip, the tube having a length between 260 and 290 mm and a diameter of 25 mm, a wall thickness of the tube is 0.8 mm which is fitted on the narrow side of the blade and touching the guard;

the wedge cone having a large side and a small side, with a length of the wedge cone of 80 mm; the pommel being fitted into the tube of the grip, a small cone side diameter is 15 mm, a large cone side diameter is 22.5 mm, a length of the extension bar is 40 mm; an extension bar diameter being 13 mm; a length of the pommel being 39 mm and a diameter of the pommel being between 25 and 41 mm.

2. A shoe horn of claim 1, wherein the shoe horn serves a dual purpose: an appliance for putting on a footwear and a weapon usable in close combat.

3. A shoe horn of claim 1, wherein the grip is mounted on the blade using a press fitting method.

4. A shoe horn of claim 1, wherein the grip shaped as the tube is press fitted on the narrow side of the blade.

5. A shoe horn of claim 1, wherein the blade and the guard are made of a stainless steel.

6. A shoe horn of claim 1, wherein the pommel is press fitted into the tube of the grip.

7. A shoe horn of claim 1, further comprising a seat for the press fitting in the grip tube, a diameter of the seat being 24 mm with a height of the seat being 4 mm.

8. A shoe horn, comprising: a blade formed as an arc shape rod having a rounded distal end with a longitudinal groove extending along an entire length thereof, a guard having a central inner slot provided for slidable receiving of the blade, a tubular shaped grip mounted on the blade, a wedge cone, the wedge cone being fitted on a narrow side of the blade and connected to the guard; a pommel, the pommel being fitted into the tube of the grip, and the wedge cone.

9. A shoe horn of claim 8, wherein the blade has a length of 830 mm and a thickness of 1.5 mm; a width of a wide side of the blade is 53 mm, a width of a narrow side is 24 mm, a radius of the wide side is 25 mm, a radius of the narrow side is 15 mm, and an outer diameter of the guard is 68 mm.

10. A shoe horn of claim 9, wherein a length of the tubular shaped grip is between 260 and 290 mm, a diameter of the tubular shaped grip is 25 mm, and a length of the wedge cone is 40 mm, a small cone side diameter is 15 mm and a large cone side diameter is 22.5 mm, with a length of the extension bar being 40 mm.

11. A shoe horn of claim 10, wherein an extension bar diameter is 13 mm; a length of the pommel is 39 mm with the pommel having a diameter between 25 and 41 mm.

12. A shoe horn of claim 8, wherein the wedge cone is made of a steel.

13. A shoe horn of claim 8, wherein the pommel is press fitted into the tube of the grip.

* * * * *